United States Patent [19]

Kopeski, Jr.

[11] Patent Number: 4,773,874

[45] Date of Patent: Sep. 27, 1988

[54] POWER CORD CLIP

[76] Inventor: Michael J. Kopeski, Jr., 5250 Waller Ct., Virginia Beach, Va. 23464

[21] Appl. No.: 89,369

[22] Filed: Aug. 26, 1987

[51] Int. Cl.[4] ..... H01R 13/639

[52] U.S. Cl. ..... 439/369; 439/370; 439/451

[58] Field of Search ..... 439/367–371, 439/451

[56] References Cited

U.S. PATENT DOCUMENTS

| | | | |
|---|---|---|---|
| 2,461,427 | 2/1949 | Kneebone | 339/75 P |
| 2,720,633 | 10/1955 | Westberg | 339/75 P |
| 2,721,313 | 10/1955 | English | 439/369 |
| 3,383,639 | 5/1968 | Anderson et al. | 339/75 P |
| 3,781,761 | 12/1973 | Harwood | 439/369 |
| 4,183,603 | 1/1980 | Donarummo | 339/75 P |
| 4,184,732 | 1/1980 | Hudson | 439/369 |
| 4,221,449 | 9/1980 | Shugart, Jr. | 339/75 P |

*Primary Examiner*—J. Patrick McQuade

*Attorney, Agent, or Firm*—Griffin, Branigan, & Butler

[57] ABSTRACT

A single piece resilient strip (10) has a back portion (12) and two opposite end portions (14 and 16) curling toward each other to form generally a C-shaped member. Outer tips (18 and 20) of the C further curl inwardly toward the back portion of the C in the manner of the lower half of a G. There are axially directed cord slots (22 and 24) located in opposite end portions of the strip for respectively receiving electrical power cords (34 and 36) of two couplers (38 and 40) to be held together therewith, with additional cord slots (30 and 32) extending to opposite side edges (26 and 28) of the strip for communicating the axially directed cord slots with the edges.

5 Claims, 1 Drawing Sheet

POWER CORD CLIP

BACKGROUND OF THE INVENTION

This invention relates generally to the art of electrical power cord accessories, and more specifically to accessories for holding plugs and receptacles of power cords together.

Frequently plugs of electrical power cords for equipment such as vacuum cleaners, electric powered lawn mowers, edge trimmers, drills, lights, and like, must be coupled to receptacles of extension cords. Similarly, plugs of extension cords are often coupled to receptacles of other extension cords. The friction connections between coupling prongs of the plugs and blades of receptacles generally will not hold the cords together against anything other than moderate separation tugs. When one uses an extension cord with a tool it is often necessary for the user to reconnect the plug with the receptacle when they become separated due to pulling or tugging action by the user.

In the past, in order to prevent two cords from separating, carpenters and others have sometimes tied two cords together in a knot. This "knot" method is unsafe because it can weaken or break one or both of the cords, creating an electrical hazard. Thus, it is an object of the invention to provide a clip for holding together male and female portions of electrical cords without damaging or weakening either of the cords.

Tape has also been used to hold cords together. Although tape sometimes holds the connectors together, it is often messy, leaving a residue of adhesive on the connectors. Sometimes tape does not work very well because of the shapes of the plugs and receptacles. It is an object of this invention to provide a device for holding together male plugs and female receptacles of electrical cords which is not messy and which is useful for almost all shapes and sizes of receptacles and plugs.

A number of clips or clamps for holding electrical cord connectors together have been suggested in the prior art. Included among these are those disclosed in U.S. Pat. Nos.: 2,461,427 to Kneebone; 2,720,633 to Westberg; 3,383,639 to Anderson et al.; 4,183,603 to Donarummo; and 4,221,449 to Shugart. However, most of these devices are critically dependent upon sizes and shapes of plugs and receptacles with which they are used, also, some of them are comprised of more than one part and are, therefore, complicated to manufacture. It is an object of this invention to provide a clip for holding together connectors of electrical cords which can be effectively used with a large spectrum of connector sizes and shapes. It is also an object of this invention to provide a clip for holding together male and female connectors of electrical cords which is inexpensive to manufacture.

SUMMARY

According to principles of this invention, an elongated, single-piece, resilient, plastic, power cord clip is molded in a strip to have a back portion between two opposite end portions which are curled toward each other to form generally a C shape whose tips are further curled inwardly toward the back portion in the manner of a lower half of a G. There are axially directed cord slots located in the opposite end portions of the clip for receiving electrical power cords of two couplers to be held together therewith. The end portions of the resilient clip can be forcefully uncurled and cords of electrical power cords can be inserted into the axial slots with connected couplers of the power cords being positioned between the end portions adjacent the back portion. When the strip is released, the end portions curl toward their original shape, thereby impinging on ends of the couplers to push them together and allowing the inwardly-directed tips to impinge on tops of the couplers to shove them toward the back portion and thereby hold the cords of the couplers in the axial slots.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
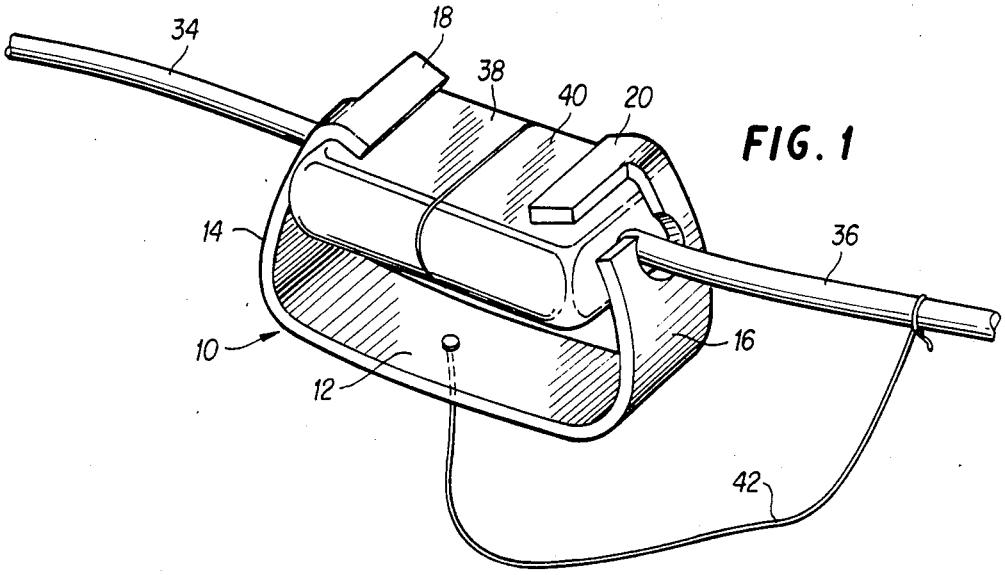
FIG. 1 is an isometric view of an electrical lower-cord clip of this invention holding male and female couplers of electrical cords together.

An electrical power-cord clip 10 of this invention is injection molded of high-density polyethylene plastic pellets to have an elongated, curled, strip form. In this respect, the strip forming the electrical-cord clip 10 has a back portion 12 and two curled end portions 14 and 16. When the electrical-cord clip 10 is molded, it is molded to have the shape shown in FIG. 3 such that the end portions 14 and 16 curl toward one another to make generally a C shape but with outer tips 18 and 20 thereof curling inwardly toward the back portion 12 in the shape of lower portion of a G. Axially directed, key-shaped, slots 22 and 24 are formed in the end portions 14 and 16 and these axially-directed slots 22 and 24 are brought into communication with opposite side edges 26 and 28 of the clip 10 by mean of laterally directed additional slots 30 and 32.

Figure 3:
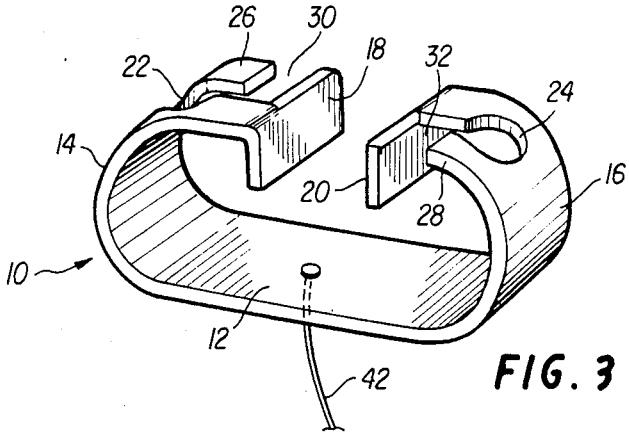
FIG. 3 is an isometric view of the power-cord clip of FIGS. 1 and 2 shown in a relaxed state in the configuration in which it is molded.

It should be understood that the high-density polyethylene plastic of which the electrical-cord 10 is molded is highly flexible, tending to return to its original molded shape of FIG. 3 when released after being deformed.

Figure 2:
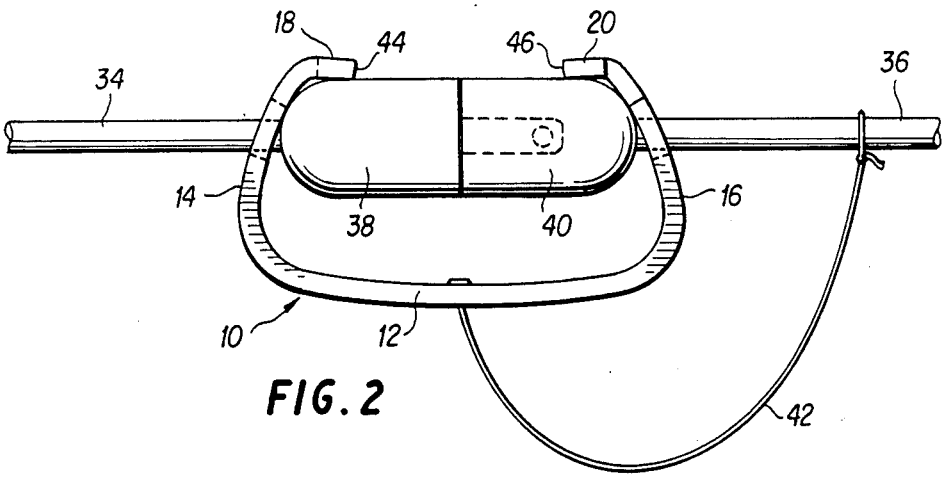
FIG. 2 is a side view of the items shown in FIG. 1.

In use, end portions 14 and 16 are manually bent outwardly, away from one another tending to move the outer tips 18 and 20 toward positions in which they are parallel to the back portion 12 as shown in FIGS. 1 and 2. Electrical cords 34 and 36 of a male plug 38 and a female receptacle 40 are inserted into the axially directed key-shaped slots 22 and 24 via the laterally-directed additional slots 30 and 32 from opposite side edges 26 and 28, with the coupled plug 38 and receptacle 40 in position adjacent the back portion 12 between the end portions 14 and 16.

The end portions 14 and 16 are then released and allowed to return toward their original configuration as shown in FIG. 3. When this happens, the end portions tend to curl toward one another, thereby impinging on ends of the male plug 38 and the female receptacle 40, to bias them together, and outer tips 18 and 20 tend to curl toward the back portion 12, thereby impinging on tops of the plug 38 and receptacle 40, tending to force them downwardly toward the back portion 12. This downward, or inward, force on the tops of the connectors 38 and 40 holds electrical cords 34 and 36 in the axially-extending key-shaped slots 24 and 26.

An embellishment of this invention is a tie cord, or stringer, 42 which is attached to the back portion 12 of the clip 10 for tying it to one of the electrical cords 34 or 36, as is shown in FIG. 2. When this is done the electrical-cord clip 10 is made constantly available at either the plug or the receptacle, depending onto which electrical cord it is tied.

It will be understood that the electrical cord clip 10, because of its resiliency, can be used with a large spectrum of coupler and cord sizes and shapes. In this respect, no matter how far the end portions 14 and 16 are separated, they will tend to curl toward one another when released, thereby accommodating an extremely wide range of plug and receptacle lengths. Similarly, the outer tips 18 and 20 will tend to move toward the back portion 12, thereby holding almost any size plug 38 and/or receptacle 40 down in the clip 10 to, in turn, hold attached electrical cords 34 and 36 down in the axially directed slots 22 and 24. Although it might be necessary to have more than one size clip for accommodating all sizes of receptacles and plugs, it will be appreciated that only a small number of different sizes will be needed since each size can accommodate such a large range of receptacle sizes and shapes.

It will also be appreciated by those of ordinary skill in the art that the electrical-cord clip of this invention is extremely inexpensive and easy to construct but yet is highly effective and useful in its operation.

While the invention has been particularly shown and described with reference to a preferred embodiment, it will be understood by those skilled in the art that various changes in form and detail may be made therein without departing from the spirit and scope of the invention. For example, it might be possible to extend the axial slots 22 and 24 to tip edges 44 and 46 rather having the lateral additional slots 30 and 32.

The embodiment of the invention in which an exclusive property or privilege are claimed are defined as follows:

1. A clip for holding male and female couplers of electrical power cords together comprising an elongated, singlepiece, resilient strip, the resilient strip having a back portion between two opposite end portions, the end portions curling toward each other to form generally a C-shape but with the outer tips of the C further curling toward the back portion in the manner of a lower half of a G, the strip defining axially directed cord slots located in opposite end portions of the strip for respectively receiving said electrical power cords of two couplers to be connected therewith, additional cord slots extending to the edge of the strip for joining said axially directed cord slots with said edge;

whereby, the end portions of said resilient strip can be forcefully uncurled and cords of electrical power cords can be inserted via said additional slots into said axial slots with connected couplers of the power cords being positioned between the end portions adjacent said back portion, and said strip can be released, thereby allowing the end portions to curl together toward their original shape, impinging on ends of said couplers to bias them together and allow the tips to impinge on tops of said couplers, thereby tending to push said couplers toward said back portion to hold the cords of said couplers in said axial slots.

2. A clip as in claim 1 wherein said additional cord slots extend in a direction lateral to an axis of elongation of said strip to extend to respective opposite side edges of said strip.

3. A clip as in claim 2 wherein said additional slots are lcoated immediately adjacent said outer tips.

4. A clip as in claim 1 wherein is further included a flexible tether means attached to said clip for being tied to an electrical cord coupled to one of said couplers.

5. A clip as in claim 1 wherein said clip is molded of a single-piece of plastic to have said G-shape at opposite ends thereof.

* * * * *